US009333625B1

(12) United States Patent
Voges et al.

(10) Patent No.: US 9,333,625 B1
(45) Date of Patent: May 10, 2016

(54) METHOD OF DESCALING STAINLESS STEEL

(71) Applicant: The Material Works, Ltd., Red Bud, IL (US)

(72) Inventors: Kevin C. Voges, Red Bud, IL (US); Alan R. Mueth, Red Bud, IL (US)

(73) Assignee: The Material Works, Ltd., Red Bud, IL (US)

( * ) Notice: Subject to any disclaimer, the term of this patent is extended or adjusted under 35 U.S.C. 154(b) by 24 days.

(21) Appl. No.: 14/562,040

(22) Filed: Dec. 5, 2014

(51) Int. Cl.
*B24C 1/08* (2006.01)

(52) U.S. Cl.
CPC ..... *B24C 1/086* (2013.01)

(58) Field of Classification Search
CPC ..... B24C 1/086; B24C 1/083; B24C 1/003; B24C 11/00; B24C 5/04
USPC ..... 451/39
See application file for complete search history.

(56) References Cited

U.S. PATENT DOCUMENTS 4,391,685 A * 7/1983 Shepard ..... C25F 1/06 205/710
4,872,294 A * 10/1989 Watts ..... B24C 3/14 451/102
5,490,908 A * 2/1996 Kim ..... C21D 9/60 148/241
5,554,235 A * 9/1996 Noe ..... B21B 45/06 148/610
5,786,556 A * 7/1998 Gronlund ..... C25C 7/00 204/206
6,088,895 A * 7/2000 Nelson ..... B21B 1/28 29/527.6
6,205,830 B1 3/2001 Voges
6,732,561 B2 5/2004 Voges
6,814,089 B1 11/2004 Voges
6,814,815 B2 11/2004 Voges
7,077,724 B1 * 7/2006 Voges ..... B21B 45/08 134/15
7,081,167 B2 7/2006 Voges
7,081,168 B2 7/2006 Voges
7,081,169 B2 7/2006 Voges
7,156,926 B2 1/2007 Voges
7,601,226 B2 * 10/2009 Voges ..... B24C 3/14 134/6
8,062,095 B2 11/2011 Voges et al.
8,066,549 B2 * 11/2011 Voges ..... B24C 3/14 451/38
8,074,331 B2 * 12/2011 Voges ..... B24C 1/086 29/81.01
8,128,460 B2 * 3/2012 Voges ..... B24C 1/086 134/6
8,707,529 B2 * 4/2014 Voges ..... B21B 45/06 29/81.01
2005/0198794 A1 * 9/2005 Love, III ..... B24C 3/12 29/81.08
2006/0108034 A1 * 5/2006 Frommann ..... B08B 7/0035 148/565
2013/0205855 A1 * 8/2013 MacKenzie ..... C21D 8/0226 72/39

* cited by examiner

*Primary Examiner* — George Nguyen
(74) *Attorney, Agent, or Firm* — Thompson Coburn LLP; Matthew Himich

(57) ABSTRACT

A method for descaling stainless steel includes providing a descaling apparatus having wheels configured to propel a scale removing media against the sheet metal. The wheels are positioned In such a way that the scale removing media propelled from one wheel does not substantially interfere with the scale removing media propelled from another wheel. The scale removing media propelled from each wheel extends across substantially an entire width of the length of the sheet metal, and the wheels are positioned adjacent opposite side edges defining the width of the sheet metal with the sheet metal centered between the wheels. In accordance with the method, a user is induced to install at least one of the descaling apparatuses in a push/pull sheet metal processing line and process stainless steel sheet metal in the line to substantially remove all scale from the surfaces of the stainless steel strip using the descaling apparatus.

16 Claims, 3 Drawing Sheets

METHOD OF DESCALING STAINLESS STEEL

BACKGROUND AND SUMMARY

This disclosure is directed to a method of descaling stainless steel using a descaling apparatus as disclosed in U.S. Pat. No. 7,601,226, the disclosure of which is incorporated by reference herein. In particular, the disclosure is directed to using such a descaler in a processing line having other machinery configured for pushing or pulling the stainless steel strip through the line.

Generally speaking, hot rolled carbon steel HRCS may be processed in a processing line having machinery configured for pushing or pulling the hot rolled carbon steel strip through the line. In these types of lines, the strip lengths of the hot rolled carbon steel are generally not welded or stitched together to form an endless strip, but are pushed or pulled through the line strip-by-strip. This allows small lots to be processed and provides some flexibility in production planning.

A typical push-pull pickling line PPPL for processing hot rolled carbon steel HRCS is shown in FIGS. 1 and 2. The processed sheet metal is uncoiled from an uncoiling reel 10 and directed through a processor 12 and a dividing shear 14. The sheet metal is then directed into a pickling tank 16 where the sheet metal is submerged in pickling solution to remove the scale. After leaving the pickling tank 16, the sheet metal is directed to a rinser 18, which removes the pickling acids from the sheet metal. The sheet metal is then dried in a dryer 20 before being directed to an inspection stand 22 and a dividing shear 24. A loop pit 26 may be provided to allow for changes in the speed of the line as the sheet metal passes through the various processing machinery. After exiting the loop pit 26, the sheet metal may pass through a steering pinch roll and a strip centering device 28. The sheet metal may then pass through a side trimmer 30, a braking stand 32, and an oiling machine 34 before being coiled on a tension reel 36.

For each production run, the hot rolled carbon steel strip HRCS may be uncoiled from the uncoiler 10 and threaded through each machine and station in the line to the coiling machinery and tension reel 36. In particular, the hot rolled carbon steel strip may be threaded through the pickling tank 16 containing a hydrochloric acid pickling solution so that the strip is immersed in the solution. Typically, the tanks 16 are formed from a granite material that not only withstands the reactivity of the hydrochloric acid pickling solution but also the wear induced by the leading edge of the steel strip during the process of threading the hot rolled carbon steel strip through the line during each coil's production run.

Hot rolled carbon steel HRCS may also be processed in a semi-continuous pickling line SCPL as shown in FIGS. 3-5. A semi-continuous pickling line SCPL includes some of the same stations and machinery as the push-pull processing line described above, but the semi-continuous line includes equipment and added loop pits that allow for differences in processing speeds at the front of the line and back of the line, and a welder or stitcher that enables the successive strips to be uncoiled and pulled through the line in a continuous fashion thereby avoiding the threading process in a push-pull processing line, which takes place for each coil's production run.

As shown in FIG. 3, the hot rolled carbon steel HRCS strip is uncoiled from an uncoiler 40 and directed through a processor 42 and a dividing shear 44. Then, a stitcher 46 joins the peeled-off, leading end of the coil to the trailing end of the then in-process strip. To allow for differences in the speed of processing between the strip being uncoiled and the then-in process strip, an entry loop pit 48 may be provided. Rollers 50 may also be provided around the stitcher 46 and/or the loop pit 48 to allow for needed variation in line speed during stitching. Once the strip exits the entry loop pit 48, the strip is directed through a pickling tank 52, a rinsing section 54, a dryer 56, and an inspection stand 58, as shown in FIG. 4. To allow for differences in processing speeds at the front of the line and back of the line, an exit loop pit 60 may be provided. As shown in FIG. 5, the strip exiting from the exit loop pit 60 may be directed to a steering pinch roll and strip centering device 62, a side trimmer 64, a braking stand 66, a dividing shear 68, and an oiling machine 70 before being coiled on a tension reel 72.

While hot rolled carbon steel HRCS may be processed in a push-pull pickling line PPPL or a semi-continuous pickling line SCPL depending upon the steel grades, the production quantity required, and the strip product dimensions, the processing of stainless steel strip involves different procedures and processes, which result in different processing line configurations, and traditionally exclude push-pull configured lines.

To descale stainless steel, an acid pickling solution is used that is more reactive than that used for hot rolled carbon steel. For instance, hydrofluoric acid is commonly used to pickle stainless steel. However, the use of hydrofluoric acid requires different design considerations for the processing line than lines using hydrochloric acid in hot rolled carbon steel processing. Hydrofluoric acid generally degrades granite, and thus the granite tanks that are traditionally used in lines processing hot rolled carbon steel must be replaced with other materials, for instance, plastic tanks. While plastic tanks are capable of withstanding the higher reactivity of the pickling solution used in lines processing stainless steel, such plastic tanks cannot withstand the wear induced from the leading edge of the strip during threading processes at the beginning of production runs. Thus, threading processes are often minimized or avoided in lines processing stainless steel to avoid premature reduction of the expected lifespan of the acid pickling tanks. Because threading processes are minimized in lines processing stainless steel, stainless steel is not traditionally processed in a push-pull processing line. Processing stainless steel in a push-pull processing line would require threading processes for each coil's production run, and the excessive threading processes would rapidly decrease the expected life of the plastic acid pickling tank. To avoid the issues associated with threading processes, stainless steel is traditionally processed in a semi-continuous or continuous processing line. The hydrofluoric acid traditionally used to pickle the stainless steel may be contained in plastic tanks, and because there are no repeated threading operations involved, there is diminished risk to damage to the plastic pickling tanks.

U.S. Pat. No. 7,601,226 describes a descaling apparatus that eliminates scale from the sheet metal and eliminates the pickling process that is used to remove scale from the surface of sheet metal. While U.S. Pat. No. 7,601,226 generally discloses a descaling apparatus that allows for descaling of both hot rolled carbon steel and stainless steels, U.S. Pat. No. 7,601,226 teaches such descaling by replacing the acid pickling tanks in a processing line with such a descaling apparatus. For instance, U.S. Pat. No. 7,601,226 and its child patents (including U.S. Pat. Nos. 8,062,095, 8,066,549, 8,074,331, and 8,128,460, the disclosures all of which are incorporated by reference herein) teach removing scale from hot rolled carbon steel and replacing the pickling tanks previously used in such processing lines with descaling apparatuses. Given the decades long practice of processing stainless steel in a semi-continuous or continuous processing line, U.S. Pat. No. 7,601,226 and its child patents merely suggest use of the disclosed descaling apparatus in a semi-continuous or continuous processing line, for instance, retrofitting a semi-continuous or continuous processing line with such a disclosed descaling apparatus. It was heretofore unappreciated that stainless steel may be processed in a push pull stainless steel processing line with such a descaling apparatus. The disclosure is directed to push-pull stainless steel processing line with a descaling apparatus, rather than the replacement of pickling tanks with a descaling apparatus in a conventional semi-continuous or continuous stainless steel processing line.

DETAILED DESCRIPTION

Figure 1:
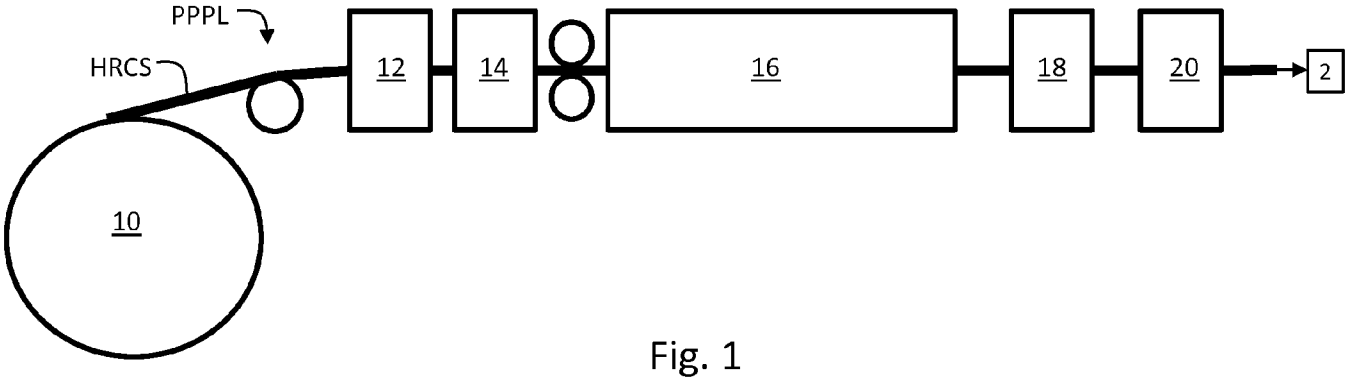
FIGS. 1-2 show a push-pull pickling processing line.
Figure 2:
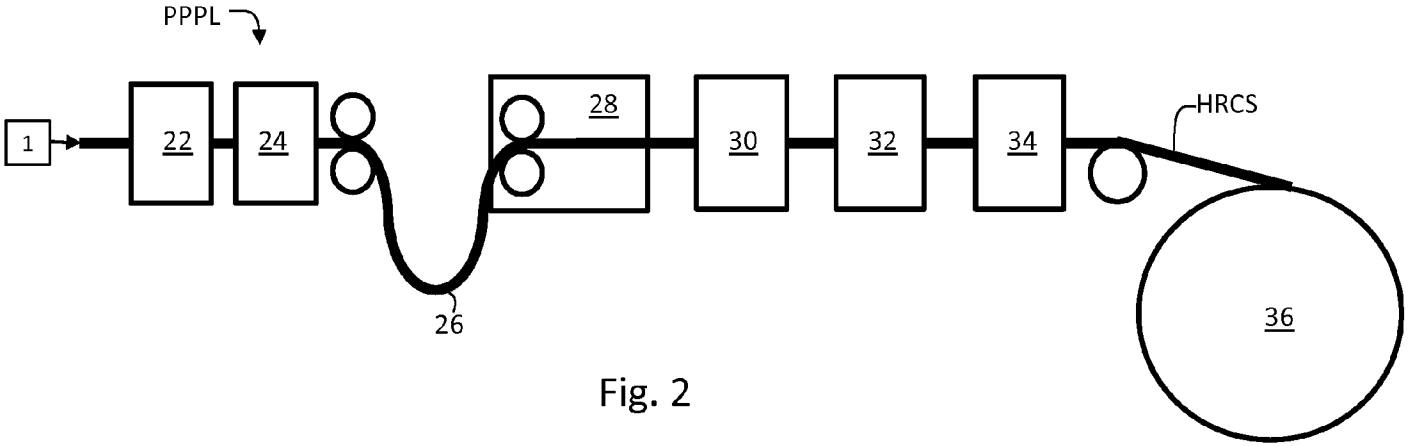
Figure 3:
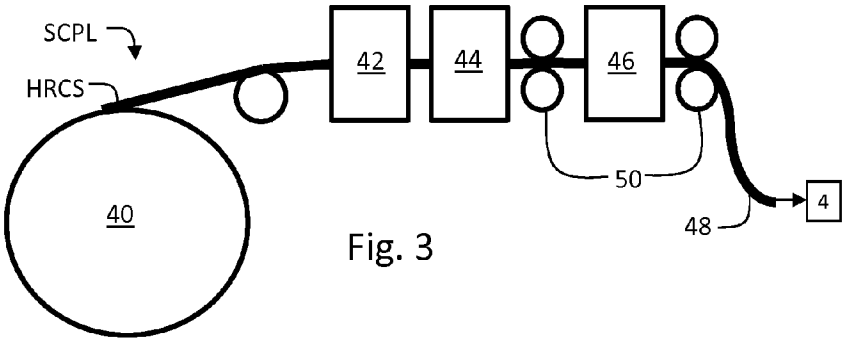
FIGS. 3-5 show a semi-continuous pickling processing line.
Figure 4:
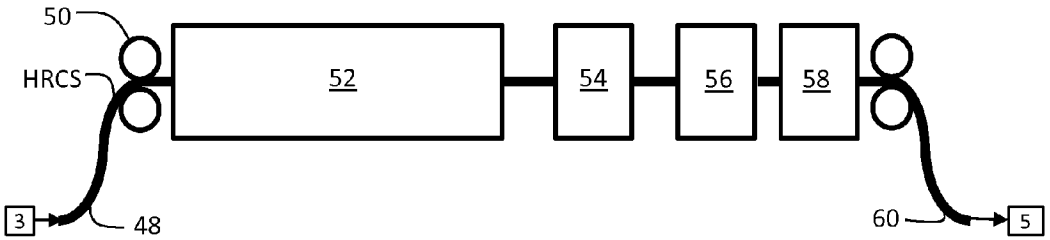
Figure 5:
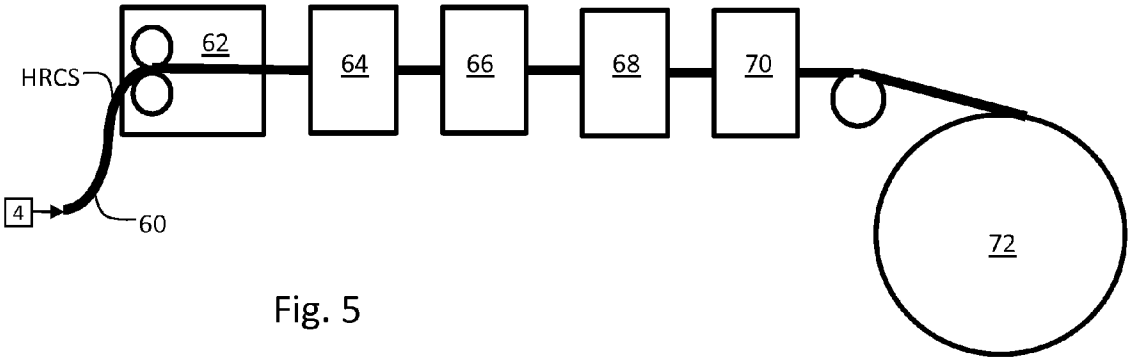
Figure 6:
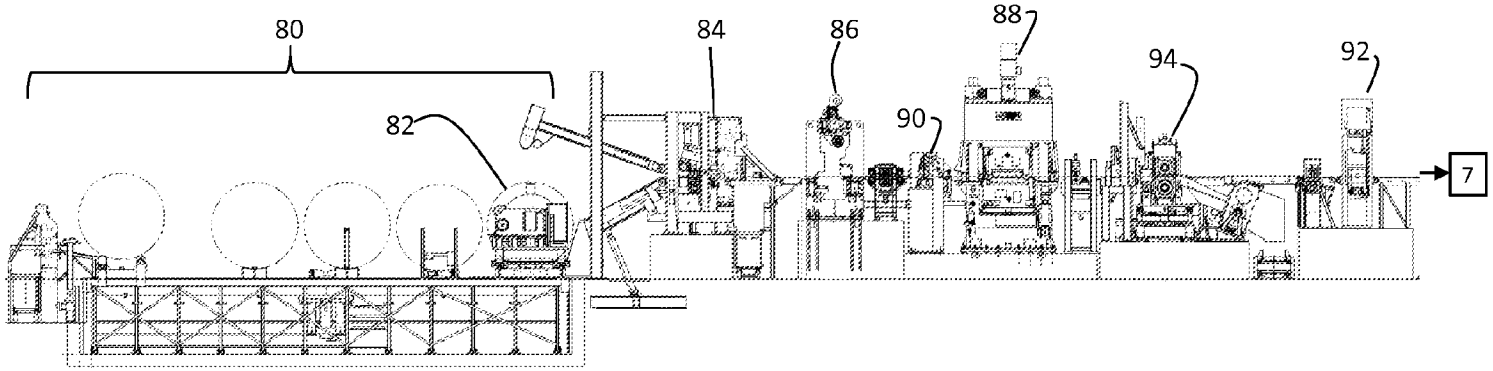
FIGS. 6-7 show a push-pull processing line for stainless steel.
Figure 7:
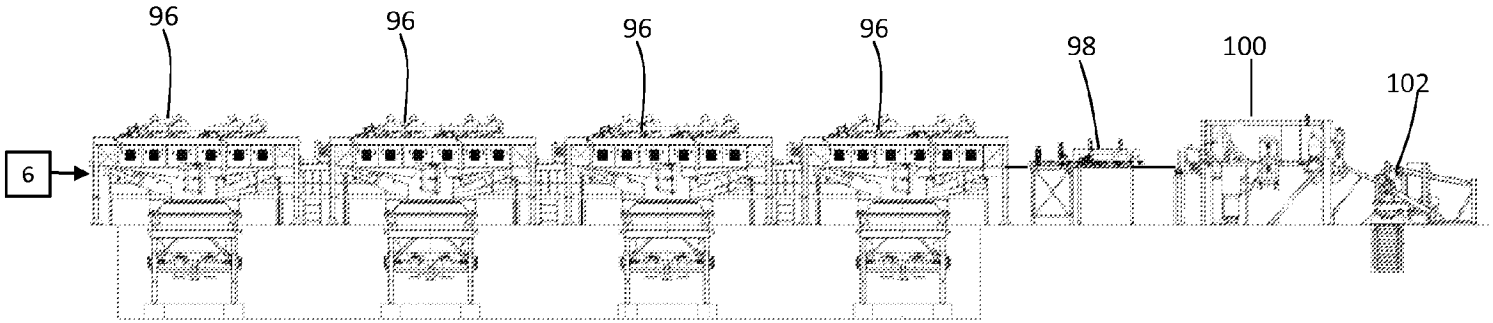

FIGS. 6-7 show an exemplary push pull processing line for stainless steel SSPPL. Such a line SSPPL may include a cropping station with a coil stage and loading system 80, including an uncoiler 82. The free end of the strip from the uncoiler may be directed to a crop shear machine 84 to shear the free end of the unpeeled coil such that it is perpendicular to the length edges of the strip thereby allowing the strip to be threaded through the line in an efficient manner. Then, the strip may be directed to a scale breaker 86 and a roller-leveler 88. Pinch rollers 90 may pull the strip through the scale breaker 86 and push the strip through the roller-leveler 88. Depending on the size material to be processed in the push-pull processing line, the line may be provided with stitching machinery 92 for connecting successive lengths of material together. For instance, if it is intended that the push-pull line process very thin gage strips of stainless steel, the free ends of strips from successive coils may be stitched together with the stitching machine 92 to enable the thin gaged materials to be pulled through the processing line. The thin gaged materials may excessively deflect when being pushed through the processing line and may require use of the tension reel to pull the material through the processing line. The stitcher may comprise a welding machine. The stitching machinery may also be omitted. In connection with the stitching machine 92, the line may be provided with an edge trimmer 94 to enable successive ends of the successive coils to be cleanly joined.

To complete the descaling process, the processing line may be provided with one or more descaling apparatuses 96 as disclosed in U.S. Pat. No. 7,601,226, and its child patents including U.S. Pat. Nos. 8,062,095, 8,066,549, 8,074,331 and 8,128,460. The descaling apparatus 96 may be operated in such a matter to propel the scale removing media against the stainless sheet metal to substantially remove all of the scale from the sheet metal. U.S. Pat. No. 7,601,226 and its child patents describe methods and parameters that which may be used in connection with descaling. The scale removing media may include a slurry comprising a grit and liquid. The scale removing media may also comprise a grit.

After the stainless steel strip leaves the descaling apparatuses, the material may pass through a drying table 98, a crop shear machine 100, and through a take up reel 102. The take up reel may comprise a recoiler, for instance, a recoiler as described in U.S. Pat. No. 8,707,529, the disclosure of which is incorporated herein by reference. U.S. Pat. No. 8,707,529, the disclosure of which is incorporated by reference herein.

The desclaling apparatus 96 may be designed, promoted, sold, or distributed as a separate machine to be included in a push pull processing line for stainless steel. A push pull processing line may be designed, promoted, sold, or distributed with a descaling apparatus included, for instance, integrated therein. In connection with the sale, promotion, design, or distribution of the descaling apparatus 96, the user, e.g. purchaser of the descaling apparatus, may be instructed that the purpose of the descaling apparatus is to enable descaling of stainless steel in a push pull sheet metal processing line. The user is induced to install the descaling apparatus in a push pull sheet metal processing line and process stainless steel in a push pull sheet metal processing line. The user may be induced to substantially remove all of the scale from at least one surface of the stainless steel sheet metal using at least on the scaling apparatus. In connection with the sale, promotion, design, or distribution of a push-pull processing line with a descaling apparatus 96 included therein, the user, e.g. purchaser of the push-pull processing line, may be instructed that the purpose of the push-pull processing line is to use the descaling apparatus 96 to descale stainless steel. The user is induced to purchase the push pull sheet metal processing line and process stainless steel in a push pull sheet metal processing line with the descaling apparatus 96. The user may be induced to substantially remove all of the scale from at least one surface of the stainless steel sheet metal using at least on the scaling apparatus.

In connection with inducing the user to perform one or more of the aforementioned steps, the user may be instructed to perform one or more of the aforementioned steps or may be directed to perform one or more of the aforementioned steps. The user may be induced to operate the descaling apparatus 96 to control the rate of impact of the scale removing media against the at least one surfaces of the stainless steel strip such that the impact of the scale removing media along substantially removes all of the scale from a surface of the stainless steel sheet metal. While U.S. Pat. No. 7,601,226 and its child patents disclose rotating impeller wheels to propel the scale removing media against the surfaces of the stainless steel sheet metal, other methods may be used to propel the scale removing media against the surfaces of the stainless steel sheet metal. The user may be induced to position the first and second impeller wheels in such a manner to propel the scale removing media against the sheet metal and substantially remove all of the scale from the stainless steel sheet metal. A pair of impeller wheels may be provided to propel the scale removing media against the sheet metal top surface and a second pair of impeller wheels may be provided to propel scale removing media against the bottom surface of the sheet metal. The number of descaling apparatuses may be selected as needed to provide a desired level of scale removal, surface finish, and sheet metal processing throughput time.

As described herein, a push-pull processing line for stainless steel sheets or strips using a descaling apparatus may replace a semi-continuous or continuous acid pickling processing line. A continuous or semi-continuous acid pickling processing line has extensive equipment that requires a very large amount of plant space. Additionally, a continuous or semi-continuous acid pickling processing line represents a significant capital investment and relatively high, long-term operating costs. These issues may be avoided with a push-pull processing line for stainless steel sheets or strips including a descaling apparatus, as described herein.

Further, generally speaking, continuous or semi-continuous acid pickling processing lines for stainless steel have as much as a 15%-30% rejection rate due to unacceptable surface condition or finish. Any rejected coils are generally reprocessed through the same continuous or semi-continuous acid pickling line. This results in additional expense in re-pickling the rejected coils. A push-pull processing line for stainless steel sheets or strips including a descaling apparatus, as described herein, may be used in the same plant as a continuous or semi-continuous acid pickling processing line. Any rejected coils may be processed on the push-pull line which is much less expensive to operate, rather than the continuous or semi-continuous acid pickling processing line.

As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A method comprising:

providing a descaling apparatus having first and second wheels configured to propel a scale removing medium against at least one surface of a length of sheet metal as the length of the sheet metal passes through the descaling apparatus in an advancement direction, the first and second wheels being positioned on the descaling apparatus to receive the scale removing medium from a supply of scale removing medium that communicates with the descaling apparatus with the second wheel being spaced from the first wheel along the advancement direction a distance sufficient such that the scale removing medium propelled from the second wheel does not substantially interfere with the scale removing medium propelled from the first wheel, the first and second wheels being operatively connected with at least one motive source to rotate the first wheel and the second wheel in opposite directions and in such a manner as to cause the scale removing medium received by the first wheel to be propelled from the first wheel against the at least one surface across substantially an entire width of the length of sheet metal passing through the descaling apparatus and cause the scale removing medium received by the second wheel to be propelled from the second wheel against the at least one surface across substantially an entire width of the length of sheet metal passing through the descaling apparatus, the first and second wheels being positionable adjacent opposite side edges defining the width of the sheet metal with the sheet metal centered between the first wheel and the second wheel; and inducing a user to:

install at least one of the descaling apparatus in a push-pull sheet metal processing line; and process stainless steel sheet metal in the push-pull sheet metal processing line to substantially remove all scale from the at least one surface of the stainless steel sheet metal using the at least one descaling apparatus.

2. The method of claim 1, wherein the step of inducing a user further comprises inducing the user to supply the scale removing medium as slurry comprising a liquid and grit.

3. The method of claim 1, wherein the step of inducing the user to install at least one of the descaling apparatus in a push-pull sheet metal processing line comprises a push-pull sheet metal processing line including a stitching machine.

4. The method of claim 1, wherein the step of inducing the user comprises instructing the user to:

install at least one of the descaling apparatus in a push-pull sheet metal processing line; and process stainless steel sheet metal in the push-pull sheet metal processing line to substantially remove all scale from the at least one surface of the stainless steel sheet metal using the at least one descaling apparatus.

5. The method of claim 1, wherein the step of inducing the user comprises directing the user to:

install at least one of the descaling apparatus in a push-pull sheet metal processing line; and process stainless steel sheet metal in the push-pull sheet metal processing line to substantially remove all scale from the at least one surface of the stainless steel sheet metal using the at least one descaling apparatus.

6. A method comprising:

providing a descaling cell configured for removing scale from sheet metal, the descaling cell comprising an enclosure with a generally hollow interior and an enclosure entrance opening and an enclosure exit opening, the descaling cell being configured to receive the sheet metal through the enclosure entrance opening and advance the sheet metal through the enclosure and out the enclosure exit opening, the enclosure entrance and exit openings being sized to accommodate a thickness of the sheet metal and a width of the sheet metal;

inducing a user to:

install the descaling cell in a push-pull sheet metal processing line;

advance a strip of stainless steel sheet metal through the descaling cell;

propel a scale removing medium against at least one of the top surface and bottom surface of the stainless steel sheet metal across the sheet metal width as the material is advanced through the descaling cell; and control a rate of impact of the scale removing medium against the at least one of the top surface and bottom surface of the stainless steel sheet metal such that the impact of the scale removing medium alone removes substantially all of the scale from a surface of the stainless steel sheet metal.

7. The method of claim 6, wherein the step of inducing the user to propel the scale removing medium further comprises to propel the scale removing medium against at least one of the top surface and the bottom surface of the sheet metal with a rotating impeller.

8. The method of claim 6, wherein the step of inducing a user further comprises inducing the user to supply the scale removing medium as slurry comprising a liquid and grit.

9. The method of claim 6, wherein the step of inducing the user to install at least one of the descaling apparatus in a push-pull sheet metal processing line comprises a push-pull sheet metal processing line including a stitching machine.

10. The method of claim 6, wherein the step of inducing the user further comprises inducing the user to:

position a first impeller wheel having a first axis of rotation adjacent a first surface of the sheet metal, the first surface comprising at least one of the top surface and the bottom surface of the sheet metal;

position a second impeller wheel having a second axis of rotation adjacent the first surface of the sheet metal;

supply the scale removing medium to the first impeller wheel and to the second impeller wheel;

rotate the first impeller wheel about the first rotation axis such that the scale removing medium supplied to the first wheel is propelled by the rotating first impeller wheel against a first area extending across substantially the entire width of the first surface of the sheet metal;

rotate the second impeller wheel about the second rotation axis such that the scale removing medium supplied to the second wheel is propelled by the rotating second wheel against a second area extending across substantially the entire width of the first surface of the sheet metal;

rotate the first impeller wheel and the second impeller wheel in opposite directions; and position the first impeller wheel and the second impeller wheel relative to the first surface of the sheet metal where the first area is spaced from the second area along the length of sheet metal.

11. The method of claim 10 wherein the step of inducing the user further comprises inducing the user to position the first impeller wheel and the second impeller wheel along adjacent opposite side edges defining the width of the sheet metal with the sheet metal centered between the first impeller wheel and the second impeller wheel.

12. The method of claim 10 wherein the step of inducing the user further comprises inducing the user to:

position a third impeller wheel having a third axis of rotation adjacent a second surface of the sheet metal that is opposite the first surface of the sheet metal;

position a fourth impeller wheel having a fourth axis of rotation adjacent the second surface of the sheet metal;

supply the scale removing medium to the third impeller wheel and to the fourth impeller wheel;

rotate the third impeller wheel about the third rotation axis such that the scale removing medium supplied to the third impeller wheel is propelled by the rotating third wheel against a third area extending across substantially the entire width of the second surface of the sheet metal;

rotate the fourth impeller wheel about the fourth rotation axis such that the scale removing medium supplied to the fourth impeller wheel is propelled by the rotating fourth wheel against a fourth area extending across substantially the entire width of the second surface of the sheet metal;

rotate the third impeller wheel and the fourth impeller wheel in opposite directions; and position the third impeller wheel and the fourth impeller wheel relative to the sheet metal where the third area is spaced from the fourth area along the length of sheet metal.

13. The method of claim 12, wherein the step of inducing the user further comprises inducing the user to position the third impeller wheel and the fourth impeller wheel along adjacent opposite side edges defining the width of the sheet metal with the sheet metal centered between the third impeller wheel and the fourth impeller wheel.

14. The method of claim 6, wherein the step of inducing the use to install at least one of the descaling apparatus in a push-pull sheet metal processing line comprises a push-pull sheet metal processing line including a stitching machine.

15. The method of claim 6 wherein the step of inducing the user further comprises directing a user to:

install the descaling cell in a push-pull sheet metal processing line;

advance a strip of stainless steel sheet metal through the descaling cell;

propel a scale removing medium against at least one of the top surface and bottom surface of the stainless steel sheet metal across the sheet metal width as the material is advanced through the descaling cell; and control a rate of impact of the scale removing medium against the at least one of the top surface and bottom surface of the stainless steel sheet metal such that the impact of the scale removing medium alone removes substantially all of the scale from a surface of the stainless steel sheet metal.

16. The method of claim 6 wherein the step of inducing the user further comprises instructing a user to:

install the descaling cell in a push-pull sheet metal processing line;

advance a strip of stainless steel sheet metal through the descaling cell;

propel a scale removing medium against at least one of the top surface and bottom surface of the stainless steel sheet metal across the sheet metal width as the material is advanced through the descaling cell; and control a rate of impact of the scale removing medium against the at least one of the top surface and bottom surface of the stainless steel sheet metal such that the impact of the scale removing medium alone removes substantially all of the scale from a surface of the stainless steel sheet metal.

* * * * *